US008308210B2

(12) United States Patent
McClenaghan et al.

(10) Patent No.: US 8,308,210 B2
(45) Date of Patent: Nov. 13, 2012

(54) LIFTING GRAB

(75) Inventors: Ian Bruce McClenaghan, Armidale (AU); Matthew Noel Schaeffer, Armidale (AU)

(73) Assignee: Ian Bruce McClenaghan, Armidale (AU)

( * ) Notice: Subject to any disclaimer, the term of this patent is extended or adjusted under 35 U.S.C. 154(b) by 470 days.

(21) Appl. No.: 12/374,684

(22) PCT Filed: Nov. 10, 2006 (Under 37 CFR 1.47)

(86) PCT No.: PCT/AU2006/001672

§ 371 (c)(1), (2), (4) Date: Jan. 19, 2010

(87) PCT Pub. No.: WO2008/017099

PCT Pub. Date: Feb. 14, 2008

(65) Prior Publication Data

US 2010/0140968 A1 Jun. 10, 2010

(30) Foreign Application Priority Data

Aug. 8, 2006 (AU) ..... 2006100677

(51) Int. Cl.
*B66C 1/62* (2006.01)

(52) U.S. Cl. ..... 294/90; 294/104

(58) Field of Classification Search ..... 294/31.1, 294/67.31, 82.13, 90, 104, 110.1
See application file for complete search history.

(56) References Cited

U.S. PATENT DOCUMENTS

| | | | | | |
|---|---|---|---|---|---|
| 521,963 | A | * | 6/1894 | Nason | 294/106 |
| 1,532,247 | A | * | 4/1925 | Kottke | 294/31.1 |
| 2,519,067 | A | * | 8/1950 | Rich | 294/104 |
| 2,576,193 | A | * | 11/1951 | Reynolds | 294/106 |
| 2,756,089 | A | * | 7/1956 | Meloy | 294/31.1 |
| 3,915,488 | A | * | 10/1975 | Anderson | 294/90 |
| 4,066,178 | A | * | 1/1978 | Carson | 414/420 |
| 4,359,241 | A | * | 11/1982 | Kistner | 294/82.13 |
| 5,161,845 | A | * | 11/1992 | Carpenter, Jr. | 294/90 |
| 6,394,739 | B1 | | 5/2002 | Hutchinson | |
| 7,278,671 | B1 | * | 10/2007 | Herford | 294/110.1 |

FOREIGN PATENT DOCUMENTS

| | | |
|---|---|---|
| DE | 3329646 | 11/1984 |
| EP | 1415921 | 5/2004 |
| RU | 1785988 | 1/1993 |
| RU | 1791329 | 1/1993 |
| SU | 1386547 | 4/1988 |
| SU | 1560457 | 4/1990 |

* cited by examiner

*Primary Examiner* — Dean Kramer
(74) *Attorney, Agent, or Firm* — Young & Thompson

(57) ABSTRACT

A lifting grab for grabbing and lifting drums and/or other objects includes: a lifting point having two or more lifting arms radiating therefrom, the arms each having rim engaging elements, at least one arm is an articulated arm movable between engaging and non-engaging positions. A drum can be grabbed by initially attaching the engaging elements of the non-articulated arms to the rim, the at least one articulated arm then brought into the rim engaging position for attachment to the object or rim. Applying an upward or lifting force to the lifting point causes the rim engaging elements of all lifting arms to forcibly grab the object or rim of the drum, and whereby on releasing the lifting force, the at least one articulated arm is first disengaged from the rim thereby also relaxing the grip of the non-articulated arms wherein the drum or object can be released from the grab.

10 Claims, 4 Drawing Sheets

LIFTING GRAB

FIELD OF THE INVENTION

This invention relates to handling and lifting equipment, in particular but not exclusively, to a lifting grab for handling and lifting cylindrical drums commonly referred to as 200 litre or 44 gallon drums.

BACKGROUND ART

The lifting of 44 gallon or 200 litre drums and other objects having a peripheral rim used to lift the object, presents a problem for farmers, truck drivers and shipping companies who have to invest in expensive and specialised lifting equipment.

Prior art devices currently available for such applications are not only expensive but are adapted to be used with specially designed lifting equipment which is generally not portable. There are however portable and inexpensive devices but these have inherent safety problems such as they are not self-centering or self-locking with respect to the load and are difficult to secure to the load where access space is limited.

Prior art examples of devices especially adapted to lift drums include devices that grasp the side of the drum using flexible straps or rigid bars that are hydraulically or electrically powered and which are only usable with specific types of lifting equipment.

At a general level, the disadvantages of this type of system or apparatus are that they are expensive, not portable, usually require hydraulic or electric power or utilise a manual lever action to apply the grasping force and as a result are not easy to be quickly or efficiently deployed or released.

The hydraulic or electric models are also not able to be adapted for use with all types of lifting devices and are not able to be used where access to the drum is restricted or when the drum is lying on its side.

Another example of the prior art includes a clamp that grasps a drum at two opposed positions near the top of the drum with a scissor or lever action that applies pressure to the sides of the drum. The disadvantage of this example is that it may not distribute weight evenly on the drum as the drum is being lifted and can result in the drum being distorted and/or damaged. The device is also not self-centering and if not properly centred, there is a danger that the drum could slip from the clamp and fall from the height to which it was lifted.

In addition, the hinges on the lever or scissor actioned apparatus could injure the hands of the worker if they become caught. The hinges also present a structural weakness that increases the risk of the drum falling and which requires regular maintenance.

A further example of the prior art includes devices which comprise a set of three (3) dangling rigid bars with hooked ends. This type of device is not self-locking and is not able to be used where the drum is lying on its side or even if the drum is leaning. If the drum or lifting device suffers any jolting action while the drum is being lifted, there is a great chance that the drum will fall from the device.

As a final example, there are devices which comprise pre-welded lugs or bars on the drum for use with a forklift or via chains attached to the lugs. This method of grasping drums means that only those drums with pre-welded lugs may be lifted. This forms a large commercial disadvantage as any other type of drum would not be able to be lifted using this method.

OBJECT OF THE INVENTION

It is therefore an object of the present invention to provide an improved lifting apparatus that seeks to ameliorate or overcome the disadvantages of the prior art herein mentioned or to at least provide the public with an alternate and useful choice.

STATEMENT OF THE INVENTION

In one aspect, the invention resides in a lifting grab for grabbing and lifting an object comprising in combination, a lifting point having two or more lifting arms radiating therefrom, the arms each having object engaging means, at least one arm is an articulated arm adapted to articulate between an engaging and a non-engaging position, wherein in use, an object can be grabbed by initially attaching the engaging means of the non-articulated arms to the object, the at least one articulated arm then brought into the engaging position for attachment to the object, and whereby on applying an upward or lifting force to the lifting point causes the engaging means of all lifting arms to forcibly grab the object, and whereby on releasing the lifting force, the at least one articulated arm is first disengaged from the object thereby also relaxing the grip of the non-articulated arms wherein the object can be released from the grab.

In another aspect, the invention resides in a drum grab for grabbing and lifting drums comprising in combination, a lifting point having two or more lifting arms radiating therefrom, the arms each having rim engaging means, at least one arm is an articulated arm adapted to articulate between a rim engaging and a non-rim engaging position, wherein in use, a drum can be grabbed by initially attaching the rim engaging means of the non-articulated arms to the rim of the drum, the at least one articulated arm then brought into the rim engaging position for attachment to the rim, and whereby on applying an upward or lifting force to the lifting point causes the rim engaging means of all lifting arms to forcibly grab the rim of the drum, and whereby on releasing the lifting force, the at least one articulated arm is first disengaged from the rim thereby also relaxing the grip of the non-articulated arms wherein the drum can be released from the grab.

Preferably, where the drum grab is used for drums having a closed end, the at least one articulated arm is biased by biasing means to be retained in the rim engaging position when the articulated arm engages the drum rim.

Preferably, the biasing means applies a compressive force against the closed end as the articulated arm is engaged with the drum rim, wherein the drum grab is retained on the drum by the compressive force notwithstanding an absence of the lifting force and wherein pushing against the force of the biasing means allows release of all arms and the disengagement of the grab from the drum.

Preferably, the portion of the biasing means in contact with the closed end of the drum has a high coefficient of friction with the surface of the closed end thereby reducing the likelihood of accidental disengagement of the arms from the rim notwithstanding any inadvertent movement or forces tending to dislodge the grab from the drum during handling or lifting operations.

Preferably, the biasing means is a compression spring depending from the articulated arm that is compressed against the closed end of the drum as the articulated arm is engaged with the drum rim.

In the alternative, the biasing means can be a strip or leaf spring depending from the articulated arm adapted to be compressed between the closed end of the drum and the articulated arm.

More preferably, the biasing means is a loop of rubber strapping or other resilient material depending from the articulated arm adapted to be compressed between the closed end of the drum and the articulated arm.

Preferably, the lifting point is a substantially centrally positioned lifting eye or hook adapted to swivel or rotate with respect to the lifting arms.

More preferably, the lifting point further includes a yoke having radial lugs or stubs to which the lifting arms are attached.

Preferably, the arms are attached by pins secured with one or more surclips passing through holes in the radial lugs or stubs and the arms. In the case of the articulated arm, only one pin is utilised to allow the arm to pivot.

Preferably, the rim engaging means is a curved member adapted to curve under and engage the rim of the drum.

In another version, the rim engaging means is detachable from the arms wherein other types of engaging means can be substituted for grabbing and/or lifting objects other than drums.

BRIEF DESCRIPTION OF THE DRAWINGS

In order that the invention be better understood and put into practical effect, reference will now be made to the accompanying drawings wherein.

DETAILED DESCRIPTION OF THE DRAWINGS

Example 1

Figure 1:
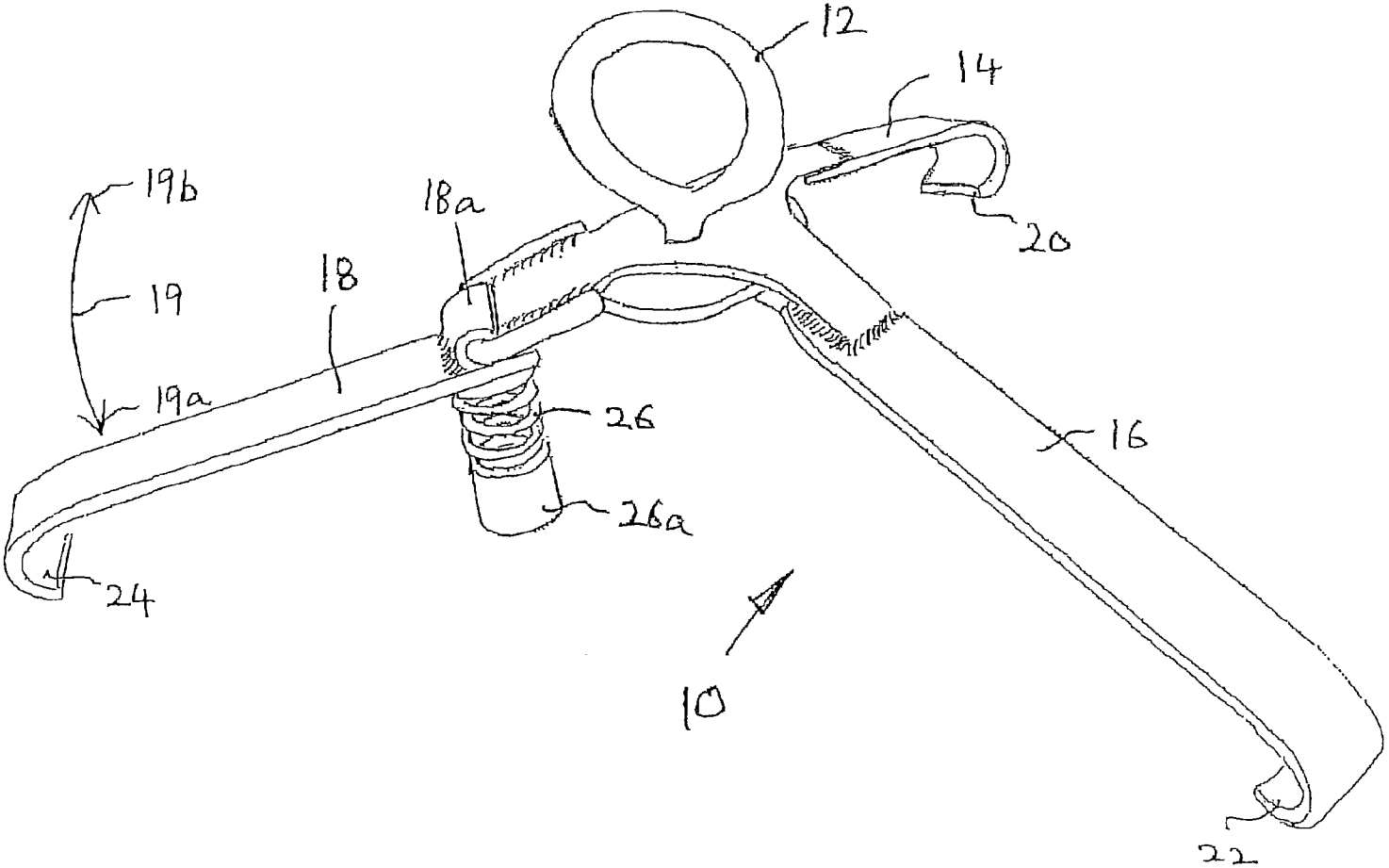
FIG. 1 shows a preferred drum grab according to Example 1 of the invention.

Referring now to the drawings and initially to FIG. 1, there is shown a preferred drum grab 10 according to Example 1. The drum grab 10 has a lifting point 12 which is preferably able to swivel around in a 360 degree circle with respect to the radiating lifting arms 14, 16, 18. In this case there are three (3) arms wherein two (2) of which are non-articulated arms 14, 16 with one articulated arm 18 having the articulation point 18*a* between the lifting point 12 and the drum rim 63.

At the end of each arm there are releasable rim engaging means 20, 22, 24 in the form of curved members adapted to curve under the rim of the drum (not shown). The articulated arm 18 can articulate as shown by arrow 19 between a rim engaging position 19*a* wherein the rim engaging means engages the rim of a drum or a non rim engaging position 19*b* for release of the other two (2) arms 14, 16. The drum is grabbed initially by attaching the rim engaging means 20, 22 of non-articulated arms 14, 16 to the rim of the drum and then bringing the articulated arm 18 downwards into a rim engaging position so that an application of the lifting force on the lifting eye 12 causes all arms to forcibly grab the drum. In order to release the drum on removal of the lifting force, the articulated arm 18 is first disengaged from the rim thereby also relaxing the grip of the non-articulated arms 14, 16 wherein the grab 18 can be removed from the drum (not shown).

Figure 2:
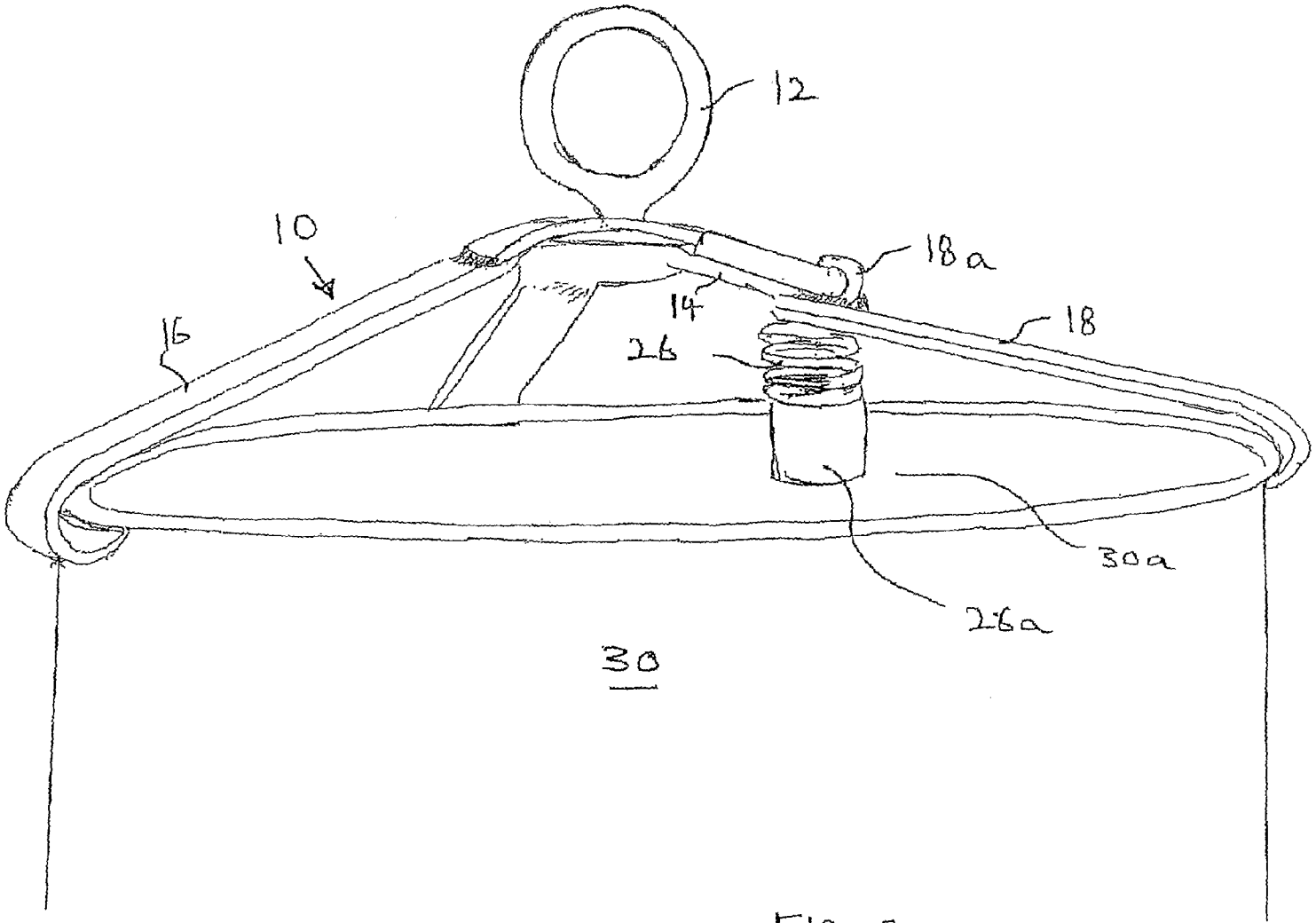
FIG. 2 shows the invention of FIG. 1 attached to a drum.

FIG. 2 shows the drum grab of FIG. 1 in use with a drum 30. There is shown a biasing means 26 in the form of a compression spring depending from the articulated arm 18. The compression spring is compressed between the articulated arm and the closed end 30*a* of the drum 30 when the articulated arm is brought downwards into the rim engaging position. The compressive force of the spring is transferred to all arms so that a moderate grabbing force is applied whereby the grab can remain on the drum even if the drum is not in a vertical position. It would be obvious to the skilled addressee that if the drum is lying on its side the drum grab can be positioned on the drum by means of the force applied by the compression spring so that the drum can be then lifted into the vertical or standing position by means of the grab.

As hereinbefore discussed, preferably the end 26*a* of the compression spring 26 or biasing means has a high coefficient of friction with the surface of the closed end 30*a* so that the spring does not slip about or lose its tension when the drum is inadvertently moved or the drum grab subjected to forces tending to dislodge the grab from the drum. It may be preferable that the end of the compression spring has a foot member 26*a* of rubber or other material which will share a high coefficient of friction with the surface of the closed end of the drum. As previously mentioned in the alternative, the biasing means can be a strip or leaf spring depending from the articulated arm which is also adapted to be compressed between the closed end of the drum and the articulated arm.

It would also be obvious to the skilled addressee that the design of the present invention affords a drum grab which is durable, safe, self-locking and self-centering as well as being easily portable. Due to the present design there is little or no maintenance required to maintain the integrity of the device which is able to be operated by one person wherein it is quick and simple to deploy and detach.

As the design has a freely swivelling lifting eye or hook, it allows the drums to spin freely so that the weight of the drum is not concentrated on any part of the device and does not distort or damage the drum.

It is also obvious that as the drum is lifted, the weight of the drum contributes to the tightening of the gripping force and that the apparatus is usable in situations where there is limited access or confined space or when the drum is lying on its side.

It will also be obvious to the skilled addressee that the drum grab may be adapted to lift and grab other loads such as logs, tractor rims, shipping containers, rocks and other irregularly shaped objects including water tanks, hay bales, car bodies and beer kegs by modifying the engaging means.

In order that the drum grab may be adapted to lift these other objects, it is preferable that the rim engaging means is detachable from the arms wherein other types of engaging means may be substituted which are adapted for the grabbing and lifting of objects other than cylindrical drums with rims.

Example 2

Figure 3:
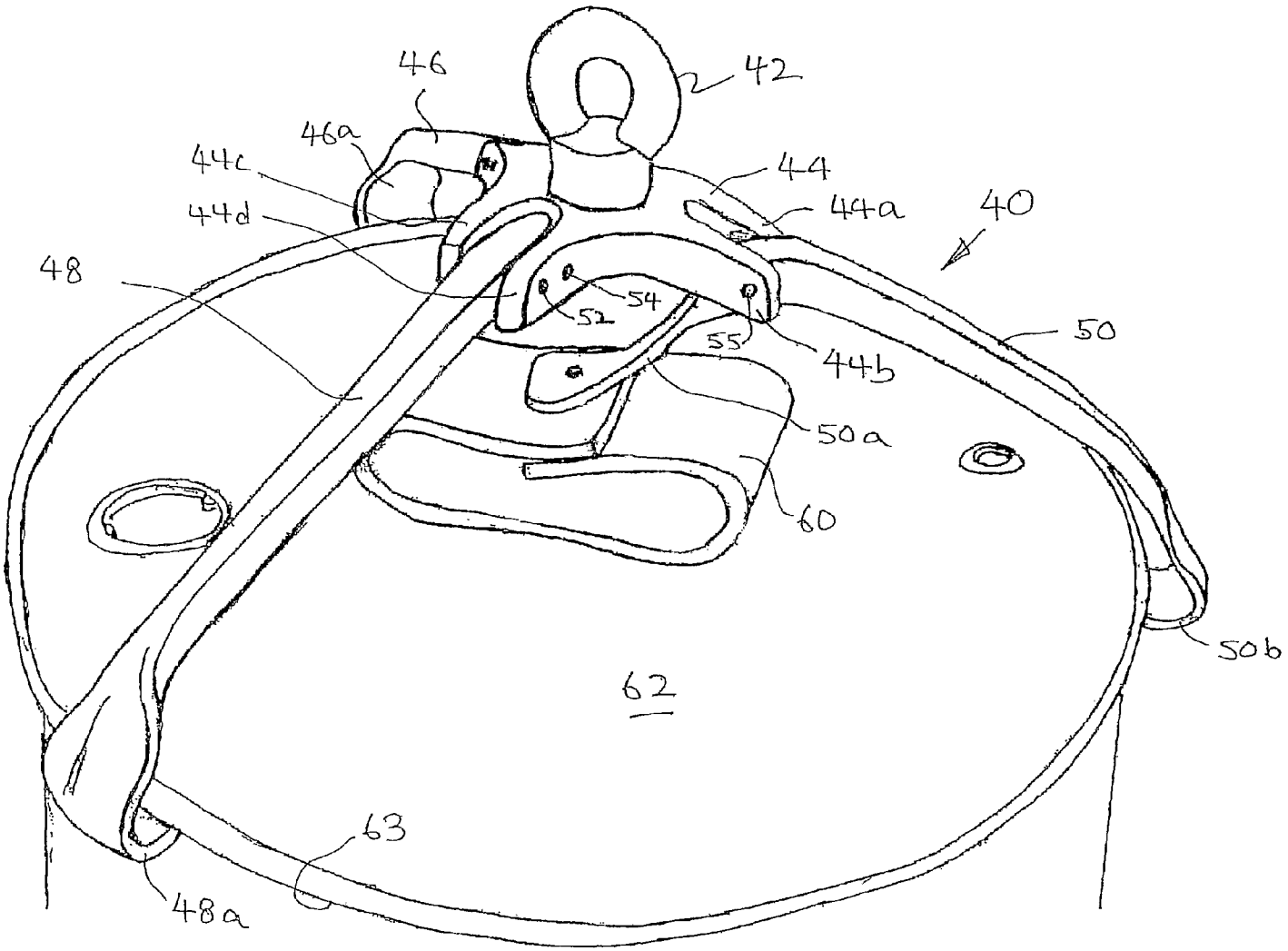
FIG. 3 and FIG. 4 show assembled and disassembled components of a drum grab according to Example 2.
Figure 4:
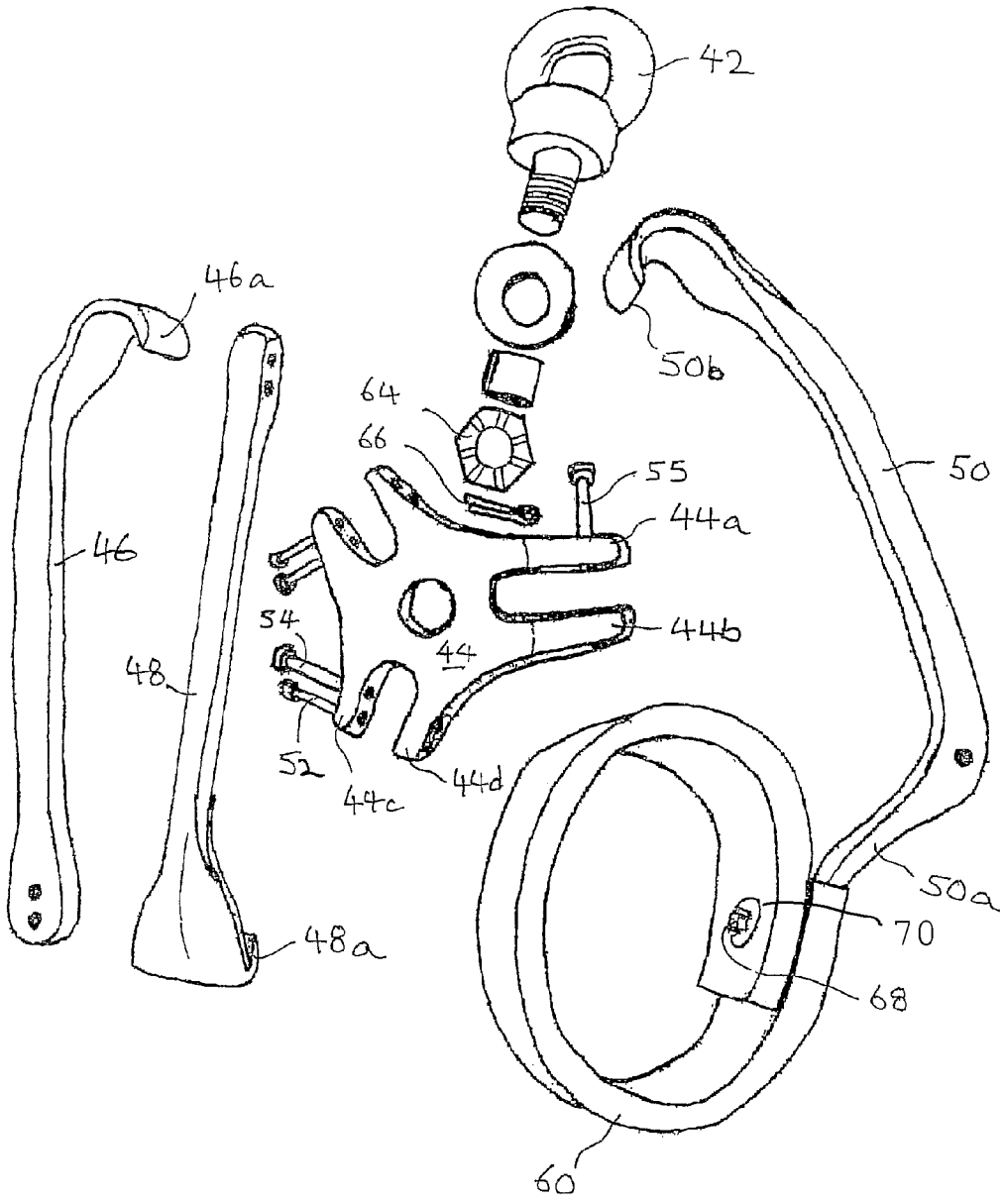

FIGS. 3 and 4 show assembled and disassembled views of the drum grab 40 according to Example 2.

The drum grab is shown with a central lifting point comprising a swivel eye 42 including a yoke 44 having stubs or lugs 44*a*, 44*b*, 44*c*, 44*d* which are forked for the attachment of the lifting arms 46, 48, 50 there between. The non-articulated arms 46, 48 are secured to the lugs or stubs by a pair of pins 52, 54 passing through holes in the lugs or stubs and the arms. The pins 52, 54 are secured by surclips (not shown). This arrangement allows the arms to be easily replaced as necessary.

The articulated arm 50 is shown attached to the lugs 44*a*, 44*b* with a single pivot pin 55 about which the arm can pivot. The arm is also preferably shown with an extension 50*a* extending to a looped strip 60 of rubber or neoprene which provides the biasing means against the lid 62 of the drum.

The swivel eye 42 is joined to the yoke 44 by means of a castellated nut 64 and split pin 66. The strip 60 of rubber or neoprene is attached to the extension of the articulated arm by means of a bolt 68 and lock nut 70. The articulated arms are shown with specially adapted curved or hooked ends 50*b*, 46*a*, 48*a* to engage the rim of the drum 63.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A drum grab for grabbing and lifting drums comprising in combination, a lifting point having at least three (3) lifting arms radiating therefrom, the arms each having drum rim engaging means, wherein one of the at least three (3) lifting arms is an articulated arm adapted to articulate between a rim engaging position and a non-rim engaging position, the articulated arm biased by a biasing means to be retained in the rim engaging position, the lifting arms other than the articulated arm are non-articulated arms, wherein a drum having a closed end is grabbed by initially attaching the rim engaging means of the non-articulated arms to the rim of the drum, the articulated arm then brought into the rim engaging position for attachment to the rim, whereby the biasing means applies a force against the closed end of the drum as the articulated arm is engaged with the drum rim, wherein the drum grab is retained on the drum by the force notwithstanding an absence of a lifting force and wherein pushing against the force of the biasing means allows all the arms to be released and the disengagement of the grab from the drum.

2. The drum grab as claimed in claim 1, wherein the portion of the biasing means in contact with the closed end of the drum has a high coefficient of friction with the surface of the closed end thereby reducing the likelihood of accidental disengagement of the arms from the rim notwithstanding any inadvertent movement or forces tending to dislodge the grab from the drum during handling or lifting operations.

3. The drum grab as claimed in claim 2, wherein the biasing means is a compression spring depending from the articulated arm that is compressed against the closed end of the drum as the articulated arm is engaged with the drum rim.

4. The drum grab as claimed in claim 2, wherein the biasing means is a strip or leaf spring depending from the articulated arm adapted to be compressed between the closed end of the drum and the articulated arm.

5. The drum grab as claimed in claim 2, wherein the biasing means is a loop of rubber strapping or other resilient material depending from the articulated arm adapted to be compressed between the closed end of the drum and the articulated arm.

6. The drum grab as claimed in claim 1, wherein the biasing means is a compression spring depending from the articulated arm that is compressed against the closed end of the drum as the articulated arm is engaged with the drum rim.

7. The drum grab as claimed in claim 1, wherein the biasing means is a strip or leaf spring depending from the articulated arm adapted to be compressed between the closed end of the drum and the articulated arm.

8. The drum grab as claimed in claim 1, wherein the biasing means is a loop of rubber strapping or other resilient material depending from the articulated arm adapted to be compressed between the closed end of the drum and the articulated arm.

9. The drum grab as claimed in claim 1, wherein the rim engaging means is a curved member adapted to curve under and engage the rim of the drum.

10. The drum or lifting grab as claimed in claim 1, wherein the lifting point is a substantially centrally positioned lifting eye or hook adapted to swivel or rotate with respect to the lifting arms.

* * * * *